US006775941B1

(12) United States Patent
McNulty, Jr.

(10) Patent No.: US 6,775,941 B1
(45) Date of Patent: Aug. 17, 2004

(54) BUILT-IN GUN LOCK FOR A PUMP-ACTION SHOTGUN

(76) Inventor: James F. McNulty, Jr., 1290 3rd St., Calimesa, CA (US) 92320

( * ) Notice: Subject to any disclaimer, the term of this patent is extended or adjusted under 35 U.S.C. 154(b) by 0 days.

(21) Appl. No.: 10/662,693

(22) Filed: Sep. 13, 2003

(51) Int. Cl.[7] ..... F41A 17/02

(52) U.S. Cl. ..... 42/70.11; 42/70.41; 42/70.02; 89/148

(58) Field of Search ..... 42/70.01, 70.02, 42/70.11; 89/148

(56) References Cited

U.S. PATENT DOCUMENTS

| | | | | | |
|---|---|---|---|---|---|
| 3,018,576 | A | * | 1/1962 | Riechers | 42/70.11 |
| 3,208,177 | A | * | 9/1965 | Barr | 42/70.01 |
| 4,058,923 | A | * | 11/1977 | Smith | 42/17 |
| 4,654,992 | A | * | 4/1987 | Lavergne | 42/70.01 |
| 4,709,617 | A | * | 12/1987 | Anderson | 89/157 |
| 5,125,178 | A | * | 6/1992 | Justice | 42/70.11 |
| 5,241,769 | A | * | 9/1993 | Von Muller | 42/70.11 |
| 5,313,733 | A | * | 5/1994 | Meade | 42/70.11 |
| 5,669,252 | A | * | 9/1997 | Bentley | 70/14 |
| 6,243,978 | B1 | * | 6/2001 | Vignaroli et al. | 42/17 |
| 6,250,008 | B1 | * | 6/2001 | Silver | 42/70.01 |
| 6,591,532 | B1 | * | 7/2003 | Gilbertson et al. | 42/70.11 |
| 6,655,066 | B2 | * | 12/2003 | Fluhr | 42/70.02 |
| 6,675,520 | B2 | * | 1/2004 | Burigana | 42/70.11 |

FOREIGN PATENT DOCUMENTS

| | | | |
|---|---|---|---|
| WO | WO96/28704 | * | 9/1996 |

* cited by examiner

*Primary Examiner*—Charles T. Jordan
*Assistant Examiner*—John Richardson
(74) *Attorney, Agent, or Firm*—Leonard Tachner

(57) ABSTRACT

An integrated or built-in key-operated gun lock having a rotatable swivel arm. The lock is preferably positioned at the fore-end of the pump slide handle so that, when deployed in the locked position, the swivel arm interferes with the forward motion of the slide handle thereby preventing the shotgun trigger from being reset for firing the weapon. This also prevents the shotgun from being locked with an ammunition round chambered. The swivel arm is preferably located between the slide arm and the pump magazine. A stationary ring may be installed on the magazine tube or, depending upon the existing configuration of the shotgun, an existing ring such as the ring commonly used to brace the magazine tube to the gun barrel, may be employed to cooperate with the swivel arm. When the lock is deployed to prevent firing of the weapon, the swivel arm is rotated into a forward-facing direction so that it contacts the stationary ring as the slide arm is slid forward along the magazine tube, but before the slide arm reaches its fully forward position where it can reset the shotgun trigger. When the lock is unlocked, the swivel arm is rotated, for example about 90° so that it can no longer interfere with the full motion of the slide arm so that the trigger can be reset or engaged and the rifle can be fired.

11 Claims, 4 Drawing Sheets

BUILT-IN GUN LOCK FOR A PUMP-ACTION SHOTGUN

BACKGROUND OF THE INVENTION

1. Field of the Invention

The present invention relates generally to the field of firearm locks and more particularly to a gun lock for pump action shotguns which is preferably key-operated and conveniently locked and unlocked without undue delay.

2. Background Art

In 1997, over thirty-five percent of United States households had firearms. Twenty-seven percent had shotguns. These homes contained 192 million firearms. Numbers of such guns have only increased since. Sixty five million were handguns. Twenty-eight million were semi-automatic weapons. Forty-nine million were shotguns. Fifty-four percent of these owners admitted that their firearms were kept unlocked. Twenty percent of the owners admitted that their firearms were kept unlocked and loaded. Thousands of children have actually died in accidental shooting deaths over the past few years, with many more injured. Forty-six percent of the owners stated that they obtained the firearms to protect themselves against criminals.

The California State Legislature found that from 1987 to 1996, nearly 2200 children in the United States under the age of 15 died in unintentional shootings. In 1996 alone, 138 children were unintentionally shot and killed. Nearly eight times this number of children are treated in U.S. hospital emergency rooms yearly for non-fatal, unintentional gun shot wounds. In 1997, the rate of such deaths in the United States was nine times higher than in twenty-five other industrial nations combined. Thus, the United States has the dubious distinction of leading the world in the rate of these deaths. A study reported in the December 1995 "Archives of Pediatric and Adolescent Medicine" found that 25% of 3 and 4 year olds and 70% of 5 and 6 year olds had sufficient finger strength to fire commonly available firearms. The GOA in its March 1991 "Accidental Shootings" estimated that 31% of accidental shooting deaths might be prevented by devices which like the present invention both made the weapon automatically resistant to discharge by a child and indicated whether the firearm is loaded.

State laws mandating the purchase of gun locks with firearms, such as California's Penal Code Section 12088.1 (a), have done little to alleviate the problem. Before locking a gun, such locks must be mounted onto the gun's trigger guard. When the gun is thereafter unlocked, the lock itself must first be unlocked and then also dismounted from the trigger guard. The time needed to unlock and dismount the locks from locked guns, renders such locked guns practically useless when they are needed to quickly respond to a threat such as where a burglar is surprised or in a home invasion robbery. So, in order to keep their weapons practically available for their stated purpose of home defense, a large portion of gun owners simply do not lock their guns, whether these gun owners have or have not been forced to purchase a lock with their guns.

The pump or slide-action shotgun is the dominant type of shotgun in the United States today. More money is spent for pumps than for shotguns of any other type, and possibly more pumps are sold than muzzle or breech loading shot guns. Just about every American manufacturer of shotguns makes a pump.

Therefore, a quickly unlocked and deployed built-in gun lock for pump-action shotguns would address a significant portion of the firearms market and alleviate a principal concern of gun owners in keeping their guns locked and, thus, safe from children and those adults not authorized to use the weapon.

SUMMARY OF THE INVENTION

The present invention, in its preferred embodiment, comprises an integrated or built-in key-operated gun lock of the type having a rotatable swivel arm. The lock is preferably positioned at the fore-end of the pump slide handle or arm (which is also sometimes itself called a forend, forend grip, forearm, forestock or stock and which moves the forearm slide) so that, when deployed in the locked position, the swivel arm interferes with the forward motion of the slide handle thereby preventing the shotgun trigger from being reset or engaged for firing the weapon. The swivel arm is preferably located between the slide arm and the pump magazine. A stationary ring may be installed on the magazine tube or, depending upon the existing configuration of the shotgun, an existing ring such as the ring commonly used to brace the magazine tube to the gun barrel, may be employed to cooperate with the swivel arm. When the lock is deployed to prevent firing of the weapon, the swivel arm is rotated into a forward-facing direction so that it contacts the aforementioned stationary ring as the slide arm is slid forward along the magazine tube, but before the slide arm reaches its fully forward position where it can reset the shotgun trigger. When the lock is unlocked, the swivel arm is rotated, for example about 90° so that it can no longer interfere with the full motion of the slide arm so that the trigger can be reset and the rifle can be fired. An elongated slot in the slide arm may be provided to permit the swivel arm to extend laterally when the lock is opened.

In an alternative embodiment, the lock is located at the rear end of the slide arm to interfere with the rearward motion of the slide arm when the lock is deployed. Irrespective of the location of the lock, the lock may optionally be simultaneously employed to activate one or more electrical circuits in the deployed or unlocked configuration, such as an optional TASER® weapon (activated when the rifle is locked) or an optional strobe light or steady light.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
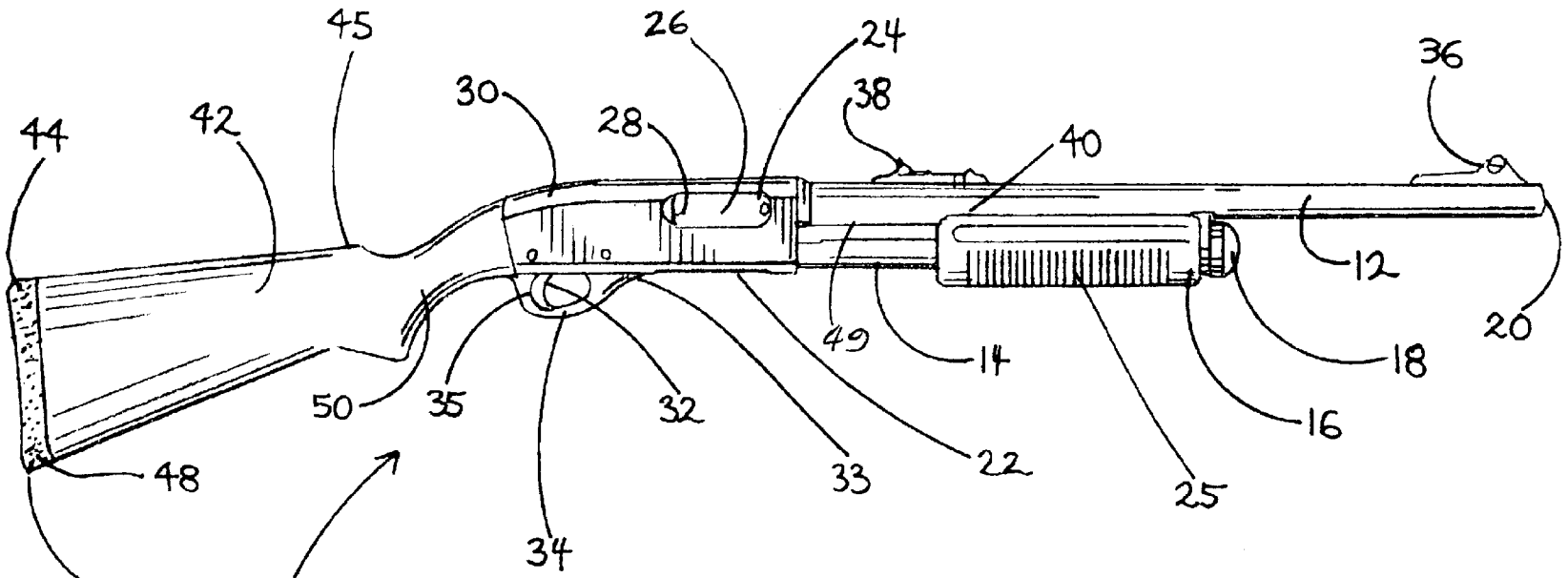
FIG. 1 (PRIOR ART)
FIG. 1 is a side view of a typical prior art pump-action shotgun which may be configured with a gun lock in accordance with a preferred embodiment of the present invention.
Figure 3:
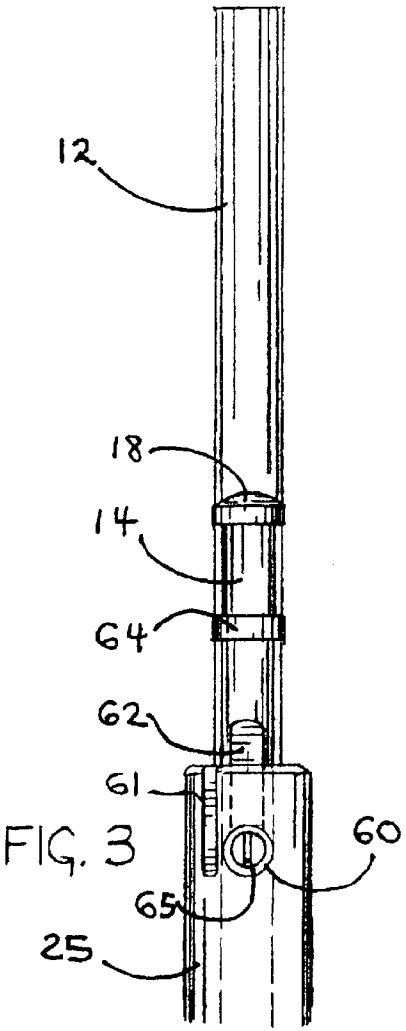
FIG. 3 is an enlarged bottom view of the fore-end of the shot gun of FIG. 1 comprising the gun lock in its locked configuration prior to its furthest forward motion.
Figure 2:
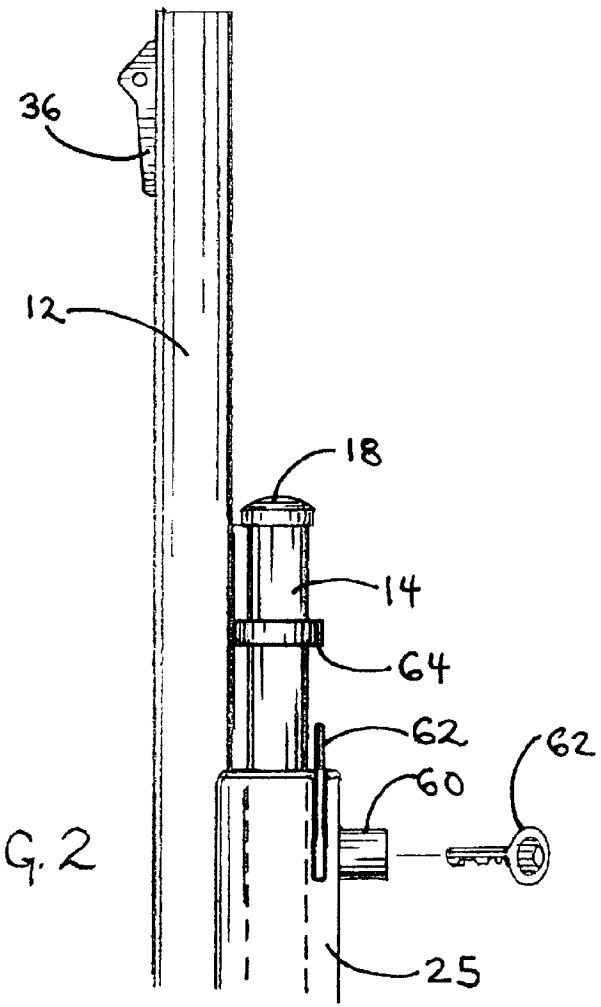
FIG. 2 is an enlarged side view of the fore-end of the shotgun of FIG. 1 comprising the gun lock in its locked configuration prior to its furthest forward motion.
Figure 5:
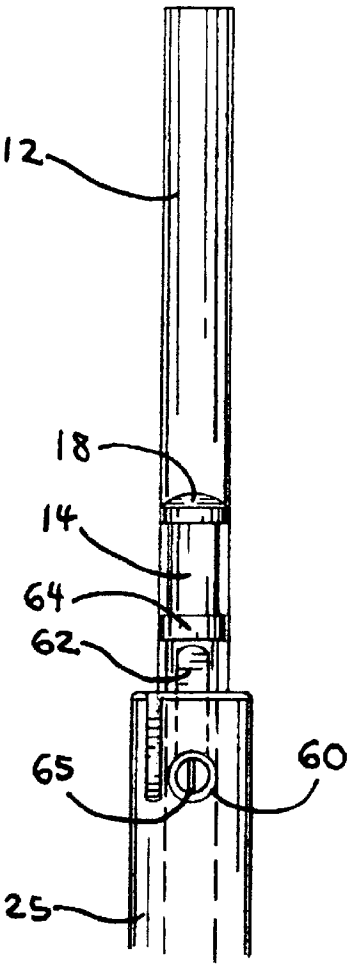
FIG. 5 is an enlarged bottom view similar to FIG. 3 but showing the gun lock in its locked configuration and in its furthest forward motion.
Figure 4:
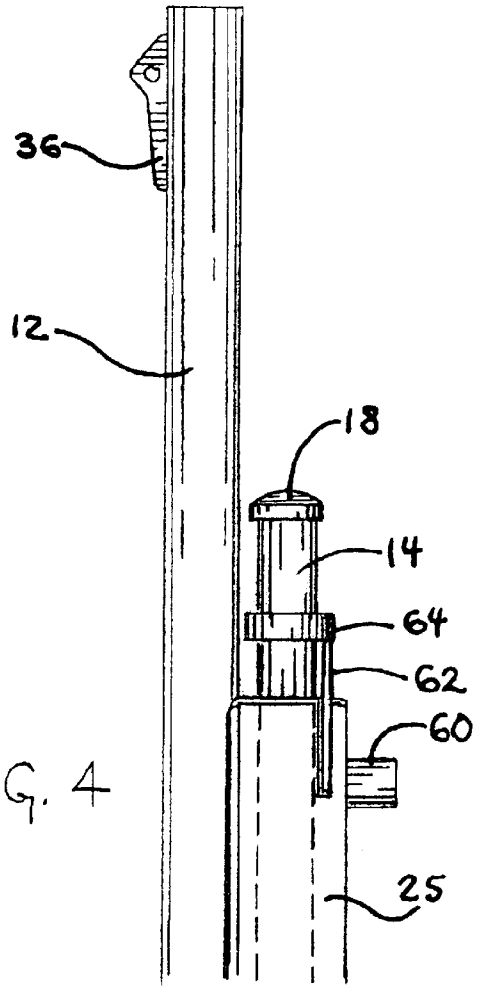
FIG. 4 is an enlarged side view similar to FIG. 2 but showing the gun lock in its locked configuration and in its furthest forward motion.
Figure 6:
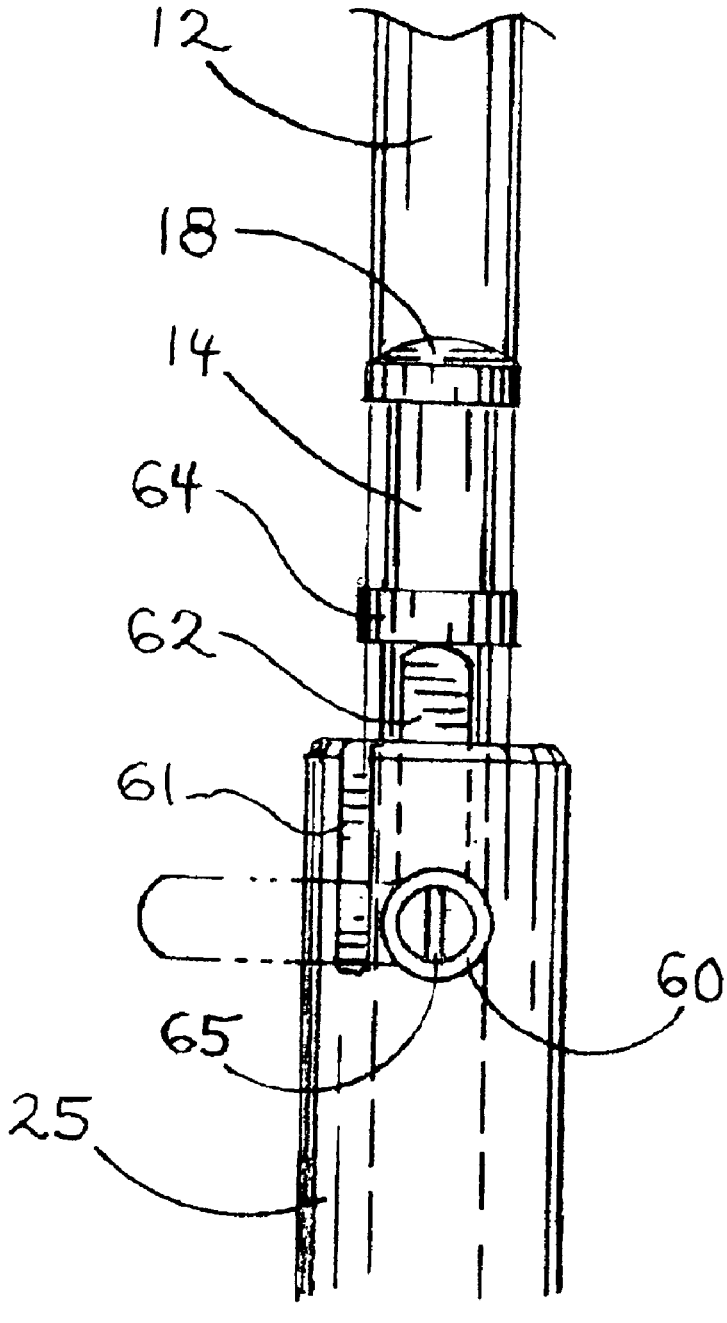
FIG. 6 is a further enlarged view similar to FIG. 5 showing both blocking contact between the swivel arm and the blocking ring and the unlocked position of the swivel arm.

Referring to the accompanying drawings, it will be seen that a conventional prior art pump-action shotgun with which the locking device of the present invention is designed to operate, is shown in FIG. 1. The illustrated shotgun 10 has the following typical components: Barrel 12, Magazine 14, Slide Arm 25, Fore-end 16, Cap 18, Muzzle 20, Loading Port 22, Extractor 24, Ejection Port 26, Bolt 28, Receiver 30, Trigger 32, Guard 34, Release 33, Safety 35, Front Sight 36, Rear Sight 38, Action Bars 40, Stock 42, Heel 44, Comb 45, Toe 46, Pad 48, forearm slide 49 and Grip 50. Such pump-action shotguns are a subclass of shotguns that are distinguished in the way in which spent shells are extracted and fresh shells are chambered. The weapon has two barrels or tubes 12 and 14 stacked vertically, with the bottom tube 14 storing between three and seven shells depending on the manufacturer and model. Fresh shells are loaded by pulling the pump handle or slide arm 25 attached to the bottom tube or magazine 14 toward the heel 44 and then pushing it forward toward the front sight 36. This action simultaneously flings the most recently fired shell out of the ejection port 26 and loads a fresh shell into the receiver 30. Only if the slide arm 25 is caused to travel to its most rearward limit and then to its most forward limit will the forearm slide engage sufficient other mechanisms so that the shotgun can be fired. The locking device of the present invention is preferably integrated into the slide arm to provide a key-controlled swivel arm for selectively obstructing at least a portion of the travel of the slide arm thereby preventing the loading of a fresh shell from being completed and thus making it impossible to fire the weapon.

The manner in which a preferred embodiment of the locking device operates to selectively obstruct the travel of the slide arm is shown in FIGS. 2–6. Referring to those figures it will be seen that a locking device 60 is integrally mounted into the fore-end 16 of slide arm 25. A swivel arm 62 is positioned between the slide arm and the magazine 14. A blocking ring 64 is affixed to the magazine in front of the slide arm so that the swivel arm will hit the ring (see FIGS. 4 and 5) when the locking device is in its deployed or locked mode. Contact between the swivel arm and the ring occurs before the slide arm can be moved to its fully forward position and thus before the shotgun can be fired. The locking device 60 may be locked and unlocked by a key 63 through a key slot 65. By simply inserting key 63 into slot 65, the shotgun may be locked or unlocked depending upon the position of swivel arm 62 as one may observe in FIG. 6. An elongated opening 61 permits the swivel arm 62 to be rotated into an unlocked position (see FIG. 6).

Those having the benefit of the present disclosure will now perceive many variations that may be readily utilized to accomplish the objects of the present invention. By way of example, the locking device may instead be located at the rear end of the slide arm to block the rearward motion of the slide arm. Moreover, the locking device may be positioned on the magazine tube with a swivel arm contacting the slide arm to selectively obstruct slide travel. Accordingly, those having skill in the field of pump action shotguns will understand that the present invention is not limited to the disclosed embodiment and that the scope hereof is limited only by the appended claims and their equivalents.

I claim:

1. A locking device for a pump-action shotgun, the shotgun having a slide arm mounted on a magazine shaft for backward and forward motion to unlock and open the shotgun ejection port, ejection of a spent shell and injection of a fresh shell from the magazine; the locking device being integrated into the shotgun and comprising a key-controlled swivel arm for selectively obstructing at least a portion of the motion of the slide arm to present unauthorized firing of the shot gun;

further comprising a ring affixed to said magazine shaft and cooperating with said swivel arm for obstructing said slide arm motion when said locking device is locked.

2. The locking device recited in claim 1 wherein said swivel arm is located between said slide arm and said magazine shaft.

3. The locking device recited in claim 1 wherein said swivel arm is positioned at the forend of said slide arm for obstructing at least a portion of said forward motion.

4. The locking device recited in claim 1 wherein said locking device is integrated into said slide arm and comprises a keyed slot for receiving a key for locking and unlocking said swivel arm.

5. A pump-action shotgun having a slide arm for backward and forward motion to expel a spent cartridge and load a new cartridge; the shotgun comprising:

a locking device integrally affixed to said shotgun for selectively obstructing said motion of said slide arm for preventing unauthorized firing of said shotgun;

wherein said locking device is integrated into said slide arm.

6. The shotgun recited in claim 5 wherein said locking device comprises an arm which can be selectively positioned.

7. The shotgun recited in claim 5 wherein said locking device is configured for obstructing at least a portion of the forward motion of said slide arm when said device is locked.

8. A pump-action shotgun having a slide arm for backward and forward motion to expel a spent cartridge and load a new cartridge; the shotgun comprising;

a locking device integrally affixed to said shotgun for selectively obstructing said motion of said slide arm for preventing unauthorized firing of said shotgun;

wherein said locking device further comprises a blocking ring affixedly attached to said shotgun for obstructing said motion of said slide arm.

9. The shotgun recited in claim 8 wherein said locking device comprises an arm that can be selectively positioned.

10. The shotgun recited in claim 5 wherein said locking device comprises a key-controlled swivel arm for selectively obstructing said slide arm motion.

11. The shotgun recited in claim 10 wherein said slide arm comprises an elongated slot to permit said swivel arm to rotate laterally when said locking device is unlocked.

* * * * *